US006650529B1

(12) United States Patent
Murata et al.

(10) Patent No.: US 6,650,529 B1
(45) Date of Patent: Nov. 18, 2003

(54) INDUCTOR AND METHOD OF MANUFACTURING SAME

(75) Inventors: Satoshi Murata, Yokaichi (JP); Etsuji Yamamoto, Yokaichi (JP); Kenji Ozawa, Omihachiman (JP); Minoru Tamada, Yokaichi (JP); Yoshihiro Nishinaga, Hikone (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/470,089

(22) Filed: Dec. 21, 1999

(30) Foreign Application Priority Data

Dec. 21, 1998 (JP) ..... 10-362809
Dec. 10, 1999 (JP) ..... 11-351576

(51) Int. Cl.[7] ..... H01F 15/02; H01F 27/26
(52) U.S. Cl. ..... 361/268; 336/177; 336/233
(58) Field of Search ..... 29/602.1, 604; 361/268; 336/233, 177, 200, 192

(56) References Cited

U.S. PATENT DOCUMENTS 4,956,114 A * 9/1990 Watanabe et al. ..... 252/62.58
5,359,311 A * 10/1994 Kawabata et al. ..... 336/233
5,529,831 A * 6/1996 Waga et al. ..... 428/209
5,530,416 A * 6/1996 Wakamatsu et al. ..... 336/233
6,084,500 A * 7/2000 Kanetaka et al. ..... 336/223
6,094,112 A * 7/2000 Goldberger et al. ..... 333/185
6,165,379 A * 12/2000 Kono ..... 252/62.59

FOREIGN PATENT DOCUMENTS

JP 360144922 A * 7/1985
JP 363003408 A * 1/1988
JP 02205309 A * 8/1990 ..... H01F/17/04
JP 11-176685 7/1999

* cited by examiner

*Primary Examiner*—Kim Huynh
(74) *Attorney, Agent, or Firm*—Keating & Bennett, LLP

(57) ABSTRACT

An inductor includes a bar-shaped ferrite core and a spiral coil. The spiral coil is formed by removing a portion of a conductive film formed at least around the peripheral surface of the ferrite core. The surface of the ferrite core is impregnated with an insulating glass before the conductive film is formed. The content of the glass is preferably about 0.1% to about 20% by weight of the ferrite core. The ferrite core is preferably an Ni—Zn-based ferrite core.

11 Claims, 5 Drawing Sheets

INDUCTOR AND METHOD OF MANUFACTURING SAME

BACKGROUND OF THE INVENTION

1. Field of the Invention

The present invention relates to inductors and methods of manufacturing the same.

2. Description of the Related Art

In a conventional inductor, a conductive film is formed by plating a film over the entire surface of an alumina ceramic member, and a spiral coil is formed by removing a portion of the conductive film via a laser to produce the inductor. However, in such an inductor, since the core is made of a non-magnetic material, a large inductance is not obtainable, resulting in large size inductors.

On the other hand, a small inductor is known, in which a thin conductive metallic layer is uniformly formed over the peripheral surface of a cylindrical magnetic core made of a magnetic material such as a ferrite, and a spiral coil is formed around the peripheral surface of the cylindrical magnetic core by trimming the conductive metallic layer via laser trimming (as disclosed in Japanese Unexamined Patent Publication No. 60-144922). In such an inductor, since the core is made of a magnetic material, a large inductance is achieved in a small size inductor.

When a conductive film is formed on the surface of a magnetic body and the conductive film is trimmed to define a spiral coil, on each end of the obtained spiral coil, the resistance of the magnetic body itself is connected in parallel to the coil. When an Ni—Zn-based ferrite which has a high specific resistance is used, the resistance thereof is usually approximately $10^8\Omega$ to $10^{12}\Omega$. When the conductive film is irradiated with a laser, the irradiation also reaches the ferrite layer under the conductive film. At this stage, since the ferrite layer is in a molten state an dissolves conductive components of the conductive film, the ferrite layer which originally had insulating properties becomes partially conductive. Consequently, a portion subjected to laser machining has a significantly decreased surface resistance, and the resistance of the overall magnetic body is decreased to approximately $10^2\Omega$. Such a resistance is connected to the coil in parallel.

Since coils usually have an impedance of $10^2\Omega$ to $10^3\Omega$, the resistance connected in parallel to the coil must be at least 10 times the value of the impedance. That is, a coil having an impedance of $10^2\Omega$ requires a resistance of approximately $10^3\Omega$, and a coil having an impedance of $10^3\Omega$ requires a resistance of approximately $10^4\Omega$. Thus, even if an Ni—Zn-based ferrite is used, when a coil is formed with a conductive film by laser machining, a resistance decreases greatly, which is undesirable.

Furthermore, in addition to the resistances arranged in parallel to the coil, resistances are connected in parallel between each turn of the coil, and decreases in such resistances are also undesirable.

Accordingly, a method is known in which an insulating layer is formed by applying an insulating coating to the entire surface of a magnetic body, and a conductive film is formed on the entire surface of the insulating layer, and thus the surface of the magnetic body is protected so as to be not directly subjected to laser machining. With such a method, a decrease in the resistance can be reduced.

However, in the above method, variations in dimensions may occur during manufacturing process. That is, when an insulating layer is formed on the surface of a magnetic body, by immersing the magnetic body in an insulating liquid glass or resin, or by coating the magnetic body, variations in the thickness of the insulating layer are added to variations in the outer diameter of the magnetic body, thus increasing tolerances. Generally, inductance changes depend on the diameter of a coil. That is, variations in the thickness of the insulating layer cause variations in inductance.

When an insulating layer is provided on the surface of a magnetic body, the insulating layer merely adheres to the surface of the magnetic body. Thus, separation of the insulating layer may easily occur, resulting in more defects as well as a decrease in reliability.

SUMMARY OF THE INVENTION

To overcome the problems described above, preferred embodiments of the present invention provide an inductor and a method of manufacturing the same in which a decrease in the resistance of a magnetic body caused by laser machining is reduced, variations in inductance due to variations in the thickness of the insulating layer and the outer diameter of the magnetic body are greatly decreased, and problems such as separation of the insulating layer from the magnetic body are prevented.

The above advantages are achieved by preferred embodiments of the present invention.

In one preferred embodiment of the present invention, an inductor includes a bar-shaped ferrite core and a spiral coil. The spiral coil is formed by removing a portion of a conductive film formed at a location at least around the peripheral surface of the ferrite core. The surface of the ferrite core is impregnated or permeated with an insulating glass before the conductive film is formed.

In another preferred embodiment of the present invention, a method of manufacturing an inductor includes the steps of impregnating the surface of a bar-shaped ferrite core with an insulating glass via thermal melting, forming a conductive film at least around the peripheral surface of the ferrite core impregnated with the insulating glass, and forming a spiral coil by removing a portion of the conductive film with laser irradiation on the ferrite core provided with the conductive film.

When the portion of the conductive film is removed via the laser, although a portion of the ferrite is also melted by the energy of the laser, the impregnated glass is also melted to form a mixture region in which the ferrite having a decreased resistance and the insulating glass are mixed. The mixture region does not become conductive due to the high resistivity ratio of the glass, thus minimizing a decrease in the overall resistance. Since the surface of the ferrite core is impregnated with the glass via thermal melting, the glass is enclosed in the ferrite, and thus problems, such as variations in the diameter and separation are overcome. Additionally, the region of the ferrite core which is impregnated with the glass includes at least the region for forming the spiral coil, and it is not necessary to include the entire surface of the ferrite core.

In another aspect of preferred embodiments of the present invention, the content of the glass is preferably about 0.1% to about 20% by weight of the ferrite core. If the glass content is less than about 0.1%, the insulating properties is insufficient, and if glass content exceeds about 20%, the impregnation into the ferrite is degraded.

In another aspect of preferred embodiments of the present invention, the ferrite core may be an Ni—Zn-based ferrite core. Although the Ni—Zn-based ferrite core has a significantly high permeability and a high resistivity ratio, the Ni—Zn-based ferrite core easily becomes conductive by being melted via laser irradiation, and thus preferred embodiments of the present invention are effective.

In another aspect of preferred embodiments of the present invention, preferably, the inductor includes a dielectric layer disposed partially or entirely on the exterior of the spiral coil, and a capacitor electrode disposed partially or entirely on the exterior of the dielectric layer. Thus, a capacitance is created between the spiral coil and the capacitor electrode via the dielectric layer. In such a case, a composite electronic component having inductance and capacitance is achieved.

Other features, elements, aspects and advantages of the present invention will become apparent from the following detailed description of preferred embodiments of the invention which refers to the accompanying drawings.

DETAILED DESCRIPTION OF PREFERRED EMBODIMENTS

Figure 1:
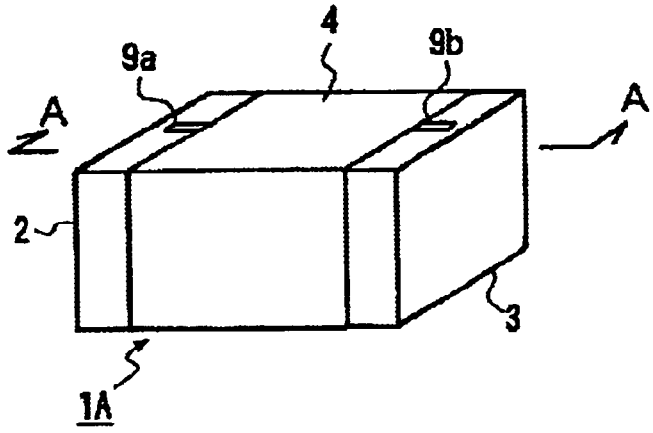
FIG. 1 is a perspective view showing an inductor according to a first preferred embodiment of the present invention.
Figure 2:
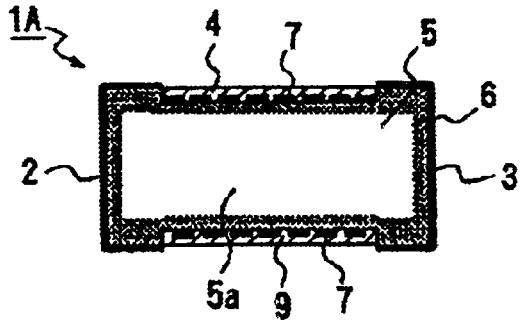
FIG. 2 is a sectional view taken along the line A—A of FIG. 1.
Figure 3:
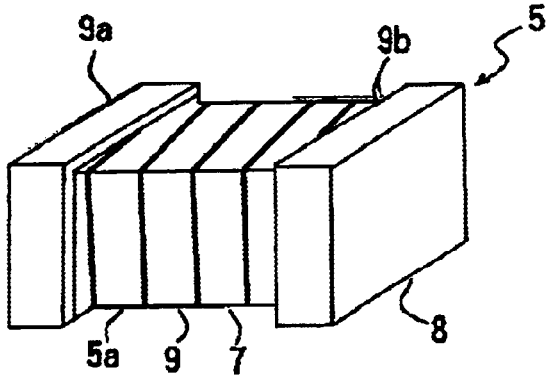
FIG. 3 is a perspective view of the inductor shown in FIG. 1 before an outer resin is applied thereto.
Figure 4:
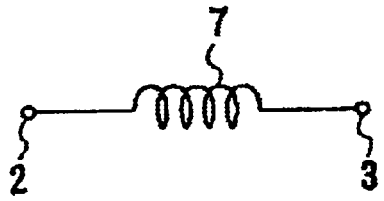
FIG. 4 is an equivalent circuit diagram of the inductor shown in FIG. 1.

An inductor according to a first preferred embodiment of the present invention is shown in FIGS. 1 to 3. FIG. 4 is an equivalent circuit diagram of an inductor 1A shown in the drawings.

On a chip-type inductor 1A, external connecting electrodes 2 and 3 are disposed on opposite ends thereof, and the middle section is covered with an outer resin 4. As shown in FIG. 2, the inductor 1A is provided with an hourglass-shaped ferrite core 5 having a slightly narrower middle section sandwiched between two wider ends. Additionally, the shape of the ferrite core 5 is not limited an hourglass shape, and various other shapes, such as substantially rectangular, substantially square and substantially cylindrical, may be used. The ferrite core 5 is preferably made of, for example, an Ni—Zn—Cu-based ferrite.

An impregnated layer 6 which is impregnated with a glass by thermal melting is disposed on the surface of the ferrite core 5. Although the impregnated layer 6 is provided on the entire surface of the ferrite core 5 in this preferred embodiment, the impregnated layer 6 may be provided only on a section in which a spiral coil 7, which will be described later, is to be formed, i.e., a narrow middle section 5*a* of the ferrite core 5.

The spiral coil 7 is preferably formed by laser trimming around the narrow middle section 5*a* of the ferrite core 5. In the formation of the spiral coil 7, a conductive film 8 preferably made of Cu or the like is formed on the entire surface of the ferrite core 5, and a portion of the conductive film 8 around the middle section 5*a* is removed by laser irradiation. In FIG. 3, a thick line 9 represents a groove cut by laser irradiation. As shown in FIG. 3 by numerals 9*a* and 9*b*, by performing laser irradiation partially on both ends of the ferrite core 5 to remove portions of external connecting electrodes 2 and 3, the Q factor can be improved. The spiral coil 7 is covered with the insulating outer resin 4 which functions as a protective layer for the spiral coil 7.

An example of a method for manufacturing the inductor 1A in accordance with the preferred embodiment described above will be described with reference to FIGS. 5A to 5D.

Figure 5A:
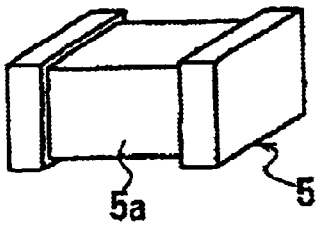
FIGS. 5A to 5D are schematic diagrams showing the steps for manufacturing the inductor shown in FIG. 1.

A ferrite core 5 shown in FIG. 5A is formed into a predetermined shape and is fired at approximately 1,000° C., followed by barrel-polishing to remove burrs.

Figure 5B:
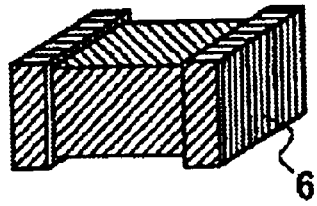

FIG. 5B shows a state in which the surface of the ferrite core 5 is impregnated with a glass. Specifically, assuming that the total weight of a plurality of ferrite cores to be impregnated is 100, about 0.1 to about 20 parts of glass powder and about 0.5 to about 5 parts of zirconia powder are measured and are mixed by stirring. The mixture is introduced into a rotary cylindrical electric furnace and is heated to about 800° C. to 900° C. while stirring, and the ferrite cores are impregnated with the molten glass. The reason for using the zirconia powder is that the individual ferrite cores are prevented from adhering to each other during the process of melting the glass powder by heating while stirring and impregnating the ferrite cores with the glass. Therefore, depending on the amount of glass impregnation, the amount of the zirconia powder may be reduced, or the zirconia powder may not be used.

Figure 5C:
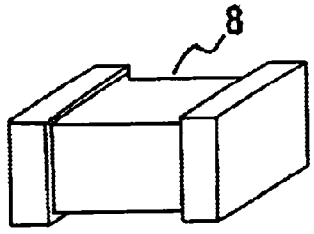

FIG. 5C shows a state in which a conductive film 8 preferably made of Cu or other suitable material is formed by electroless plating over the entire surface of the ferrite core 5 impregnated with the glass. The method for forming the conductive film 8 is not limited to plating, and vapor deposition or other suitable processes may be used.

Figure 5D:
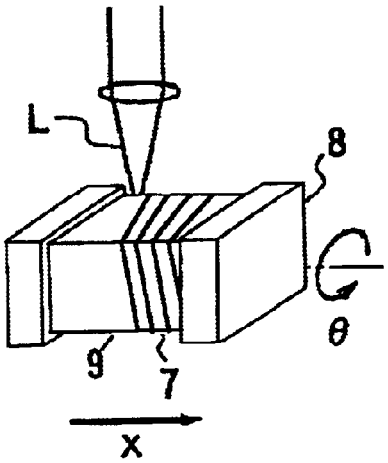

FIG. 5D shows a state in which a spiral coil 7 is formed by irradiation with a YAG laser beam L applied to the ferrite core 5 provided with the conductive film 8. For example, the ferrite core 5 is mounted on a rotary feeder (not shown), and the ferrite core 5 is moved in the axial direction X at a constant velocity while the ferrite core 5 is rotated in direction q about the axis at a constant velocity. A portion of the conductive film 8 is removed by applying the laser beam L in a direction that is substantially orthogonal to the axis of rotation of the ferrite core 5, and thus a spiral coil 7 is obtained. The conductive film 8 formed on both ends of the ferrite core 5 is not irradiated with the laser and therefore remains, such that the conductive film remaining at both ends of the ferrite core 5 defines as external connecting electrodes 2 and 3.

After the spiral coil 7 is formed, an outer resin 4 is applied to the ferrite core 5 in a region excluding both ends. Additionally, it is desirable that a thin film of Ni and Sn be further formed by electrolytic plating on the external connecting electrodes 2 and 3 at both ends in order to improve resistance to soldering heat and solder wettability so that mounting on a substrate is facilitated.

Figure 6:
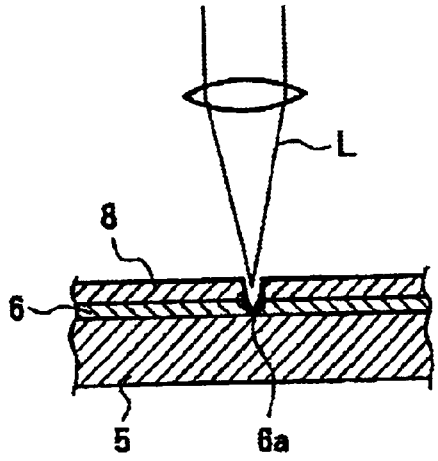
FIG. 6 is a sectional view of a section which is irradiated with a laser.

When the portion of the conductive film 8 is removed with the laser beam L, as shown in FIG. 6, the laser irradiation also reaches the glass-impregnated layer 6 beneath the conductive film 8. At this stage, besides the ferrite, the impregnated glass is also melted to form a mixture region 6*a* including the ferrite and the glass. In the mixture region 6*a*, a decrease in resistance is prevented due to the higher resistivity ratio of the glass in comparison with the case in which the ferrite with decreased resistance only is used, and thus the insulation resistance that is sufficient for practical use can be maintained.

In accordance with experiments by the inventors, it has been found that, when an Ni—Zn ferrite core is formed by firing with high density, namely, with low pore density, and the ferrite core is impregnated with about 0.1% by weight of a zinc borosilicate-based glass, a decrease in the resistance can be suppressed to approximately $10^3\Omega$ by adjusting the depth of laser irradiation to a large extent, and the above-described advantages are achieved. It has also been confirmed that, when an Ni—Zn-based ferrite core is formed by firing with low density, namely, with high pore density, for example, by mixing about 4% by volume of organic particles having a size of about 0.05 mm to a ferrite material, and the ferrite core is impregnated with about 20% by weight of a zinc borosilicate-based glass, a decrease in the resistance due to laser irradiation can be suppressed to approximately about $10^5\Omega$.

Figure 7:
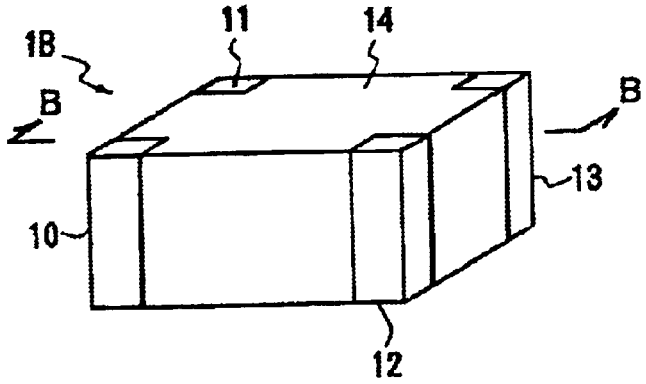
FIG. 7 is a perspective view showing an inductor according to a second preferred embodiment of the present invention.
Figure 8:
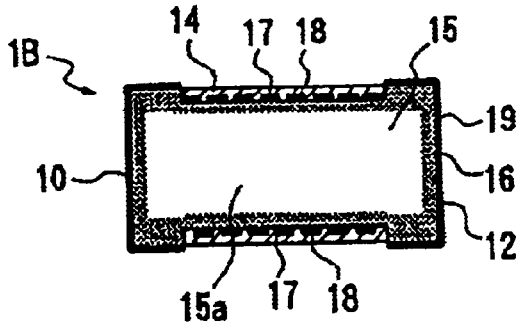
FIG. 8 is a sectional view taken along the line B—B of FIG. 7.
Figure 9:
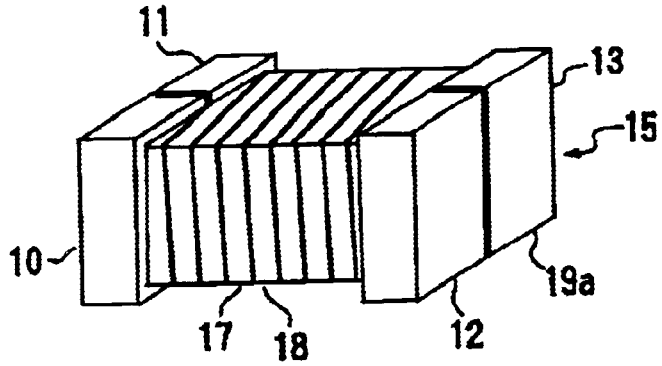
FIG. 9 is a perspective view of the inductor shown in FIG. 7 before an outer resin is applied thereto.
Figure 10:
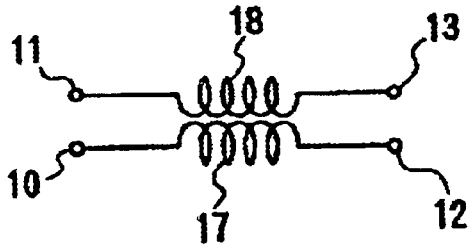
FIG. 10 is an equivalent circuit diagram of the inductor shown in FIG. 7.

An inductor according to a second preferred embodiment of the present invention is shown in FIGS. 7 to 9. The inductor corresponds to a common-mode choke coil or transformer. FIG. 10 is an equivalent circuit diagram of an inductor 1B shown in the drawings.

On the chip-type inductor 1B, external connecting electrodes 10 to 13 are located on four corners, and the remaining portions of the inductor 1B is covered with an outer resin 14. As shown in FIG. 8, the inductor 1B is provided with an hourglass-shaped ferrite core 15 having a slightly narrower middle section sandwiched between two large ends, and an impregnated layer 16 which is impregnated with a glass is formed on the surface of the ferrite core 15. A plurality of (for example, two, in this preferred embodiment) spiral coils 17 and 18 are formed by laser trimming around a narrow middle section 15*a*. The spiral coils 17 and 18 are formed, in a manner similar to that in the first preferred embodiment, after a conductive film 19 preferably made of Cu or other suitable material is formed over the entire surface of the ferrite core 15 by removing a portion of the conductive film 19 by laser irradiation around the middle section 15*a*.

In order to form the spiral coils 17 and 18, in a manner similar to that shown in FIG. 5D, the ferrite core 15 is moved in the axial direction at a constant velocity while the ferrite core 15 is rotated about the axis at a constant velocity, and a portion of the conductive film 19 is removed by applying a laser in a direction that is substantially to the axis of rotation of the ferrite core 15. By repeating the above operation, two spiral coils 17 and 18 are formed with the same number of turns. A conductive film 19*a* on the end is divided into two sections by laser irradiation or by using a cutter so that the individual coils 17 and 18 are isolated (refer to FIG. 9), and external connecting electrodes 10 to 13 are separated.

The outer resin 14 is applied around the spiral coils 17 and 18 and to both ends, and thus a protective layer for the spiral coils 17 and 18 is formed, and simultaneously, short-circuiting between the spiral coils 17 and 18 is prevented. Additionally, a thin film of Ni and Sn may be formed on the external connecting electrodes 10 to 13 in order to improve resistance to soldering heat and solder wettability.

Furthermore, in order to improve electrical properties such as inductance, a magnetic material (e.g., a resin including ferrite powder or magnetic material powder) may be further provided at a periphery of the ferrite core 15 excluding both ends. That is, by mixing the magnetic material powder into the outer resin 14, magnetic lines of force are effectively collected, thus inductance increases and coupling with other peripheral components is prevented.

In this preferred embodiment, since the impregnated layer 16 which is impregnated with a glass is also formed on the surface of the ferrite core 15 by laser irradiation, a mixed region is produced in which the ferrite having a decreased resistance and a glass having insulating properties are simultaneously melted. As a result of this mixed region, a decrease in resistance between the spiral coils 17 and 18 is reduced, and sufficient insulating properties for practical use can be maintained. Since the insulation between the spiral coils 17 and 18 is improved, the coils 17 and 18 can be wound in proximity to each other, thus increasing the coupling coefficient.

Figure 11:
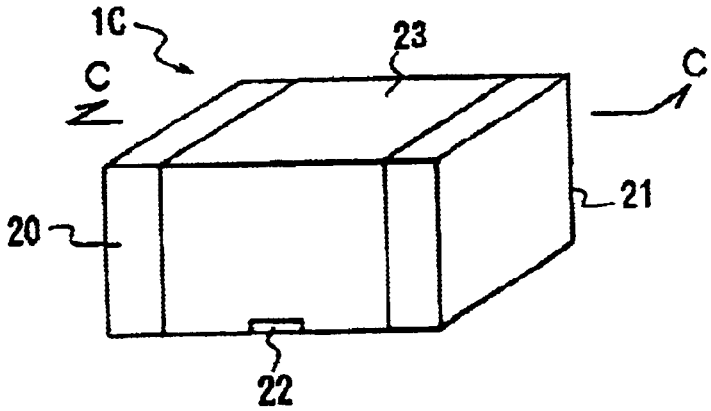
FIG. 11 is a perspective view showing an inductor according to a third preferred embodiment of the present invention.
Figure 12:
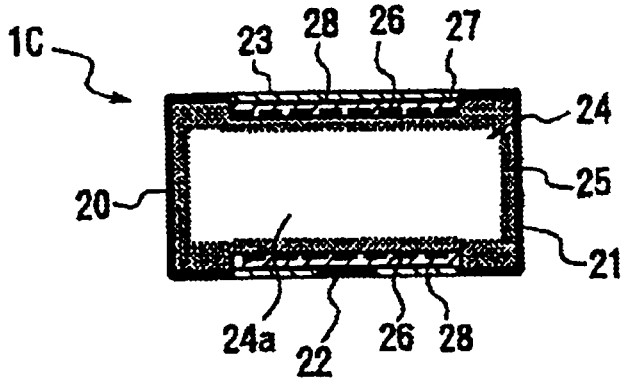
FIG. 12 is a sectional view taken along the line C—C of FIG. 11.
Figure 13:
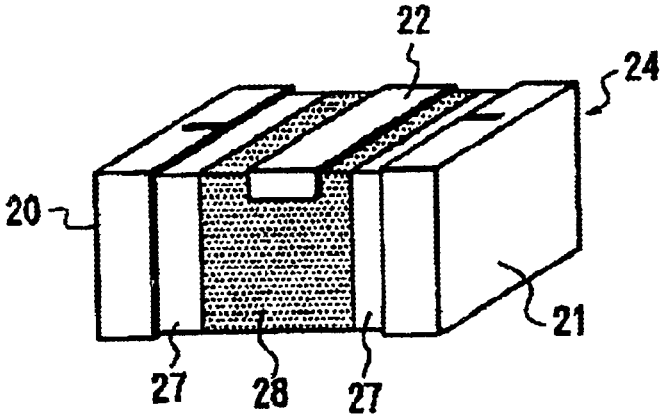
FIG. 13 is a perspective view of the inductor shown in FIG. 11, viewed from the bottom side, before an outer resin is applied thereto.
Figure 14:
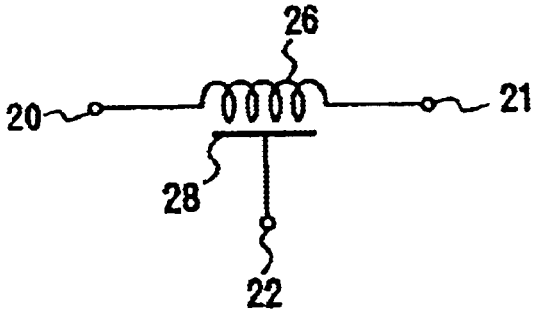
FIG. 14 is an equivalent circuit diagram of the inductor shown in FIG. 11.

An inductor according to a third preferred embodiment of the present invention is shown in FIGS. 11 to 13. The inductor corresponds to a composite electronic component having inductance and capacitance, such as an LC filter. FIG. 14 is an equivalent circuit diagram of an inductor (LC filter) 1C shown in FIGS. 11–13.

On the chip-type inductor 1C, first and second external connecting electrodes 20 and 21 are formed on corresponding ends, and a third external connecting electrode 22 is formed on the bottom surface thereof. The remaining portions of the inductor 1C is covered with an outer resin 23. The inductor 1C is provided with a ferrite core 24 having the same shape as that in FIG. 3, and an impregnated layer 25 which is impregnated with a glass is formed on the surface of the ferrite core 24 (refer to FIG. 12). A spiral coil 26 is formed by laser trimming around a narrow middle section 24*a* of the ferrite core 24. The method for manufacturing the spiral coil 26 is the same as that in the first preferred embodiment (refer to FIGS. 5A to 5D).

The entire surface of the outer periphery around the spiral coil 26 is coated with a dielectric layer 27 including an epoxy resin or the like, and a capacitor electrode 28 is formed around the outer periphery of the dielectric layer 27 by sputtering, vapor deposition, or other suitable process. Thus, a capacitance is formed between the spiral coil 26 and the capacitor electrode 28 via the dielectric layer 27. Furthermore, on the bottom surface of the capacitor electrode 28, the third external connecting electrode 22 is formed by printing or other suitable process so as to slightly protrude from the capacitor electrode 28.

After the third external connecting electrode 22 is formed, the outer resin 23 is applied to the ferrite core 24 in a region excluding both ends. The third external connecting electrode 22 is not covered with the outer resin 23.

In this preferred embodiment, as shown in FIG. 14, an inductance is created between the first and second external connecting electrodes 20 and 21, and a capacitance is created between the first or second external connecting electrodes 20 or 21 and the third external connecting electrode 22, namely, between the spiral coil 26 and the capacitor electrode 28, thus the LC filter is produced.

The present invention is not limited to the preferred embodiments described above.

Although examples of chip-type inductors are described in the preferred embodiments, the invention is not limited to the chip-type, and lead terminals may be used instead of external connecting electrodes.

Although hourglass-shaped ferrite cores having slightly narrower middle sections sandwiched between two large ends are described in the preferred embodiments, the present invention is not limited to this, and various alterations can be made depending on the application of the component. Although the sections for forming spiral coils have a substantially cube-shaped or rectangular-shaped configuration in the preferred embodiments of the present invention, substantially cylindrical sections may be used.

Although laser machining is used for forming spiral coils in the preferred embodiments, other processing methods such as sandblasting and water-jet cutting may be used.

As is clear from the above description, in accordance with preferred embodiments of the present invention, since an impregnated layer impregnated with an insulating glass is provided on the surface of a ferrite core before a conductive film is formed, when a portion of the conductive film is removed with a laser, the glass is also melted together with the ferrite by the energy of the laser to form a mixture region in which the ferrite having a decreased resistance and the insulating glass are mixed, thus minimizing any decrease in the overall resistance.

Since the surface of the ferrite core is impregnated with the glass, the glass is enclosed in the ferrite, and thus problems such as variations in the diameter and separation are overcome. Therefore, reliable inductors having reduced variations in inductance can be obtained.

While the invention has been particularly shown and described with reference to preferred embodiments thereof, it will be understood by those skilled in the art that the forgoing and other changes in form and details may be made therein without departing from the spirit of the invention.

What is claimed is:

1. An inductor comprising:

a ferrite core;

an insulating glass impregnated or permeated into a surface of said ferrite core to form a mixture region including ferrite and said insulating glass mixed with each other and provided on and near the surface of the ferrite core;

a conductive film formed on said mixture region provided on the surface of the ferrite core; and a spiral coil; wherein the spiral coil is formed by removing portions of the conductive film at least around a peripheral surface of the ferrite core.

2. An inductor according to claim 1, wherein the content of the glass is about 0.1% to about 20% by weight of the ferrite core wherein the ferrite core is Ni—Zn-based.

3. An inductor according to claim 1, further comprising:

a dielectric layer disposed at least partially on an exterior of the spiral coil; and a capacitor electrode disposed at least partially on the exterior of the dielectric layer;

wherein a capacitance exists between the spiral coil and the capacitor electrode.

4. An inductor according to claim 1, wherein the ferrite core has an hourglass-shaped configuration having a narrower middle section disposed between two wider ends.

5. An inductor according to claim 1, wherein the inductor is a common-mode choke coil.

6. An inductor according to claim 1, wherein the inductor is a transformer.

7. An inductor according to claim 1, further comprising external connecting electrodes located on four corners of the ferrite core.

8. An inductor according to claim 1, wherein a portion of the inductor is covered with an outer resin.

9. An inductor according to claim 1, wherein a magnetic material is provided on the periphery of the ferrite core except on opposite ends of the ferrite core.

10. An inductor according to claim 1, wherein the inductor is used in an LC filter.

11. An inductor according to claim 1, wherein the ferrite core has a substantially bar-shaped configuration.

* * * * *